United States Patent [19]

Holce et al.

[11] Patent Number: 4,543,458

[45] Date of Patent: Sep. 24, 1985

[54] SWITCH AND CONNECTOR ASSEMBLY INCLUDING PROTECTIVE HOUSINGS FOR JUMPER CABLE

[75] Inventors: Thomas J. Holce, Portland; Charles M. Huckins, Tigard, both of Oreg.

[73] Assignee: Sentrol, Inc., Portland, Oreg.

[21] Appl. No.: 644,319

[22] Filed: Aug. 24, 1984

[51] Int. Cl.[4] ..... H01H 3/16; H01H 36/00

[52] U.S. Cl. ..... 200/61.7; 335/205

[58] Field of Search ..... 200/61.62, 61.7, 61.71–61.75, 200/61.76–61.82, 61.93; 335/205, 207

[56] References Cited

U.S. PATENT DOCUMENTS

| | | | |
|---|---|---|---|
| 2,620,411 | 12/1952 | Liley | 200/61.7 |
| 4,210,888 | 7/1980 | Holce | 335/207 |
| 4,213,110 | 7/1980 | Holce | 335/207 |

*Primary Examiner*—J. R. Scott

*Attorney, Agent, or Firm*—Chernoff, Vilhauer, McClung, Birdwell & Stenzel

[57] ABSTRACT

A connector assembly for effecting mechanical and electrical connection between a portion of a security alarm or similar circuit mounted on a swinging door or window and a portion of such a circuit located on fixed structure adjacent the door or window, including a resilient electrical cable mechanically connecting a pair of terminal housings which protectively cover the cable and terminals at the ends of the cable when the housings are located adjacent one another with the door closed. The housings may also enclose an electrical sensor, such as a magnetically actuated switch and an actuating magnet, electrically connected with the terminals, for connection with a security alarm circuit.

16 Claims, 7 Drawing Figures

SWITCH AND CONNECTOR ASSEMBLY INCLUDING PROTECTIVE HOUSINGS FOR JUMPER CABLE

BACKGROUND OF THE INVENTION

The present invention relates to electrically-operated physical security alarm systems, and particularly to application of such systems to protect hingemounted doors including glass panels.

In the past, security alarm circuits have protected windows mounted on hinges, and doors including windows, by the use of metal foil tape attached to the glass so as to fracture, opening an electrical circuit if the glass is broken. In order to connect such metal foil conductors to the portion of an alarm circuit extending from such a door to an alarm control panel or the like, a flexible jumper cable has been connected loosely between the door and a portion of the alarm system circuit fastened to supporting structure located adjacent the door. A problem in this arrangement has been that the electrical conductors contained within such a cable break, causing false alarms, frequently within a short period after installation. This may occur because of stress concentrations at the ends of the loosely suspended portion of the cable extending between the door and its doorway frame, as the result of the cable being accidentally caught by objects being carried through the doorway, or because of the cable being pinched as the door is closed.

Another problem associated wit such a jumper cable used to connect a glass-protecting circuit to the remainder of an alarm circuit is that the jumper cable is visibly exposed, providing an unattractive appearance and offering an attractive target for tampering.

Security alarm systems detect unauthorized opening of doors by the use of sensors often including magnetically-actuated switches in either normally-open or normally-closed circuit arrangements. Connection of such sensors to an alarm system intrusion detection circuit to protect a door has previously required a switch housing to be mounted in a doorway, and has also, depending on the type of switch installed, in some cases required a magnet to be mounted on the door to be protected. As a result, the installation of switches, magnets, and jumper cables to fully protect a door having glass panels has previously required an undesirably long time, resulting in undesirably high labor costs.

What is needed, therefore, is a connector assembly providing for a reliable connection between alarm system intrusion detection circuits and a hinge-supported window or a door having windows, which will provide for detection of both opening the window or door and breakage of the glass, which will provide protection against tampering and inadvertent damage, and which will provide a better appearance than the previously used loosely hanging exposed jumper cables.

SUMMARY OF THE INVENTION

The present invention overcomes the disadvantages and shortcomings of the previously used loosely hanging jumper cables for use in providing electrically-operated security system protection for doors including windows, by providing a pair of cooperative terminal housings including terminals for making electrical connections to separate portions of an intrusion detection circuit. The housings and the terminals contained within them are connected to one another both mechanically and electrically, according to the present invention, by an elastically extensible cable containing the necessary electrical conductors. The cable used in the terminal and switch housing of the present invention retracts itself to a protected location within a cable cavity defined cooperatively by the housings, as the window or door protected in accordance with the invention is closed. Thus the connecting cable is kept out of sight when a door on which the connector assembly of the present invention is used is closed, leaving a neat appearance, and protecting the cable against both intentional and accidental damage, although the cable is extensible to maintain the electrical circuit when the door is swung open. In a preferred embodiment of the invention the cable is of the type which coils itself into a small helix and the cable cavity is a generally rectangular one aligned to hold the helix with its central axis oriented vertically.

The housings of the present invention also provide specifically designed mounting locations for a magnetically-actuated switch, for example a magnetic reed switch, and for an actuating magnet. The actuating magnet and switch are properly located with respect to one another in the housings to sense whether the door is open or closed when the two housings are properly located to cooperatively and protectively house the jumper cable upon closure of the door being protected.

It is therefore a principal object of the present invention to provide a continuous electrical connection between a fixed, nonmovable portion of a security alarm circuit and a portion of the circuit which is located on a hinge-mounted door or other structure similarly movable through only a limited distance and usually left in a predetermined position when the security alarm is activated.

It is another important object of the present invention to provide a set of housings for protecting terminals used in connecting a part of a security alarm circuit to another portion of the security alarm circuit, while also housing a switch assembly which can detect certain relative motion between the housings.

It is an important feature of the present invention that it provides a connector including two separate electrical terminals, each located in a respective terminal housing, with the housings connected to each other physically and the terminals connected to each other electrically by a self-coiling multi-conductor cable which pulls itself into a cavity defined cooperatively by the separate terminal housings when the housings are brought together in predetermined relative positions.

It is another important feature of the present invention that it provides a pair of housings which protectively hold a magnetically actuated switch and an actuating magnet, while also protectively enclosing terminals for a jumper cable used to connect a part of an alarm system circuit carried on a movable object to the remainder of the circuit, and protecting the terminal connection posts against tampering.

It is a principal advantage of the present invention that it provides better protection of the conductors and terminals of a jumper cable than has previously been possible.

It is another advantage of the present invention that it provides a connector and switch housing assembly which makes it easier than it previously was to provide reliable complete alarm system protection of a door including windows.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
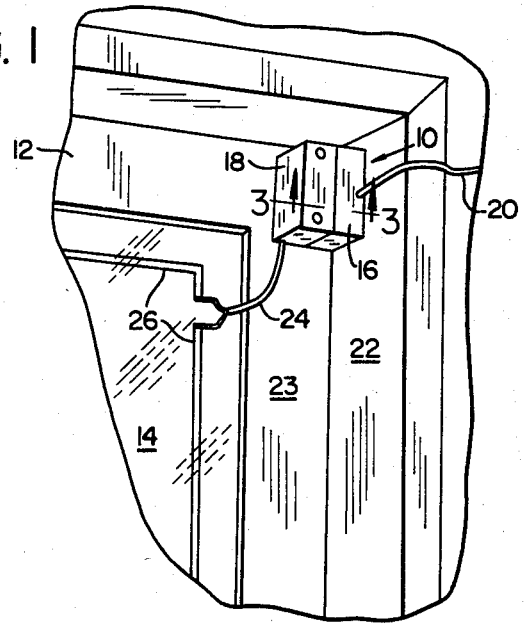
FIG. 1 is a perspective view of a portion of a doorway and a closed door having a glass window where a switch housing and connector assembly embodying the present invention is installed.
Figure 5:
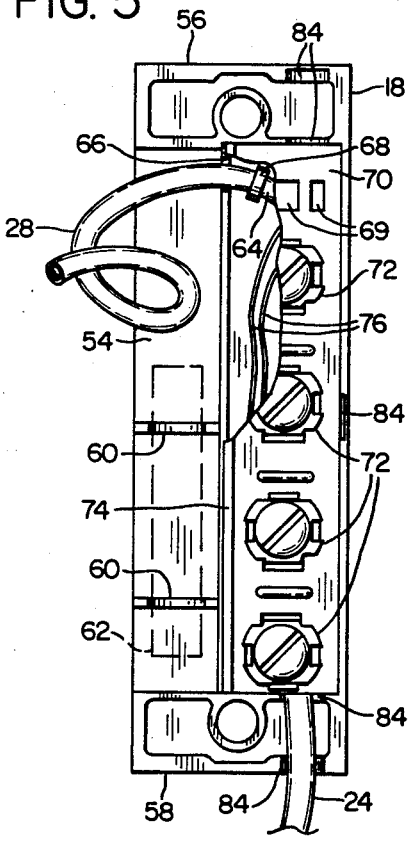
FIG. 5 is a rear elevational view of the door mounted housing portion of the switch housing and connector assembly shown in FIG. 1, at an enlarged scale.
Figure 6:
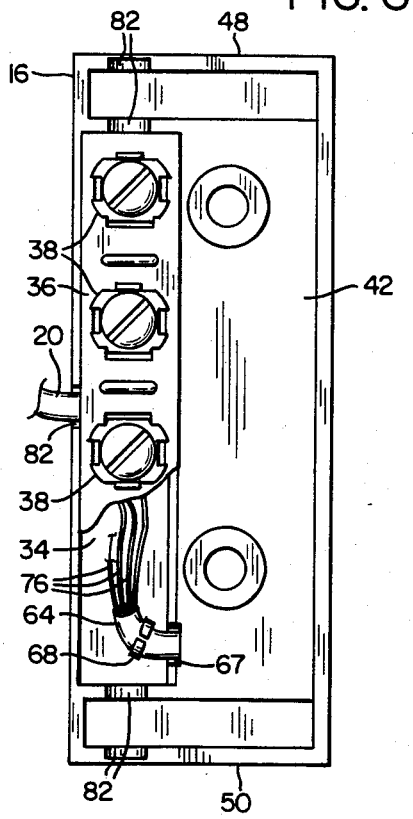
FIG. 6 is a right side elevational view of the door frame-mounted housing portion of the switch housing and connector assembly shown in FIG. 1, at an enlarged scale.

Referring now to the drawings, in FIG. 1 a switch housing and connector assembly 10 embodying the present invention is shown in use protecting an outwardly opening door 12 including a windowpane 14. The switch housing and connector assembly 10 is seen to include a pair of housings mounted on the inner side of door 12 so that they fit closely together when the door 12 is closed, as shown in FIG. 1. The first of these housings is a switch housing 16, while the other is a magnet housing 18. An alarm system detection loop cable 20 carries electrical conductors into the switch housing 16, which is fixedly mounted on a surface 22 of the doorway which is perpendicular to the plane of the door 12 when the door is closed as shown in FIG. 1. The magnet housing 18 is fixedly mounted upon a flat surface 23 of the door 12, as shown in FIGS. 1 and 2, and a conductor cable 24 leads from the magnet housing 18 to a metal foil tape 26 which forms a portion of a normally-closed electrical circuit utilized to detect breakage of the glass pane 14.

Figure 2:
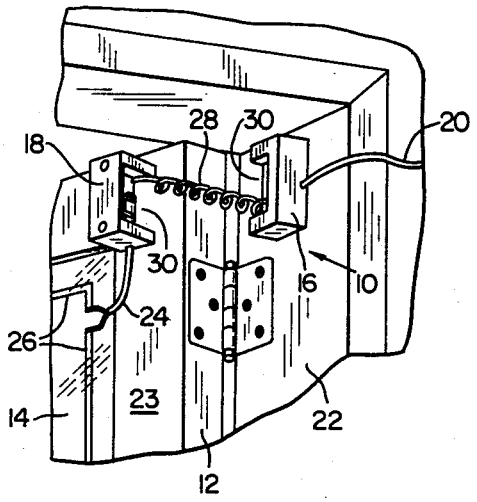
FIG. 2 is a perspective view of the doorway, door, and switch housing and connector assembly shown in FIG. 1, with the door opened.
Figure 3:
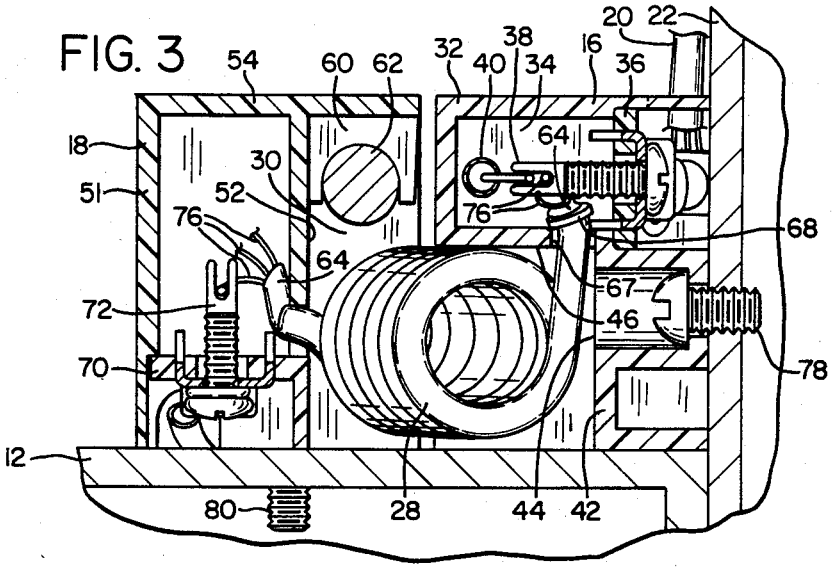
FIG. 3 is a sectional view of the switch housing and connector assembly shown in FIG. 1, taken along line 3—3, at an enlarged scale.
Figure 4:
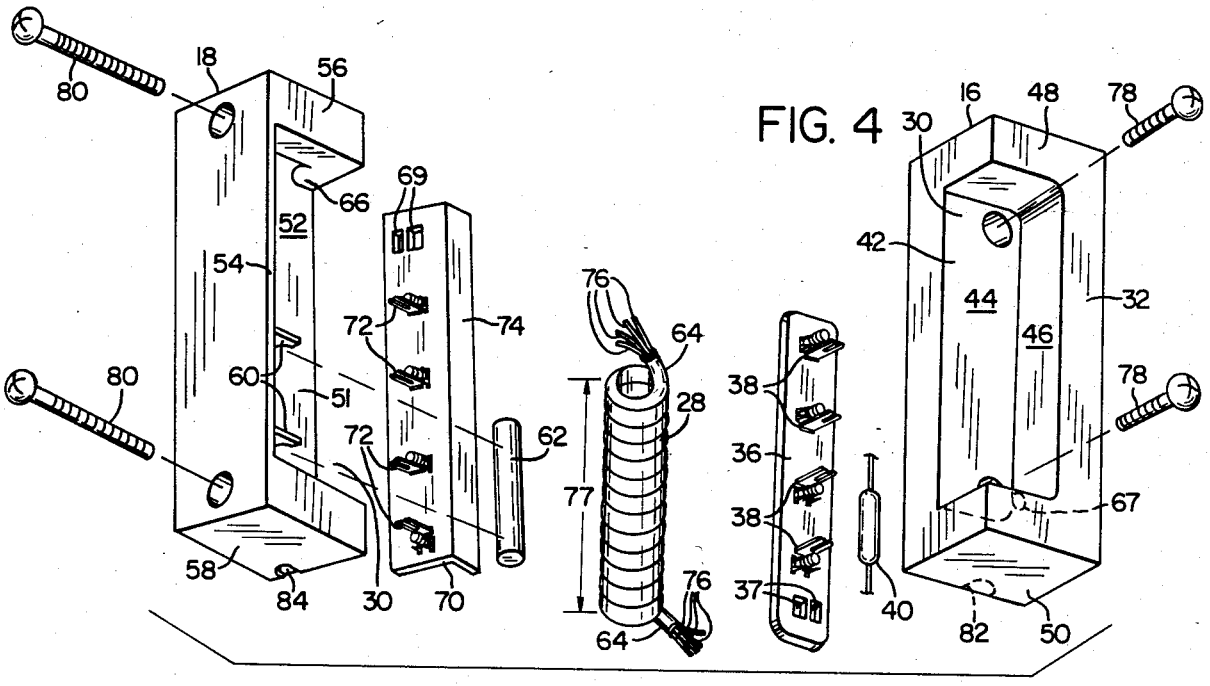
FIG. 4 is an exploded view of the switch housing and connector assembly shown in FIG. 1, at an enlarged scale.

Referring now also to FIG. 2, a cable 28 mechanically and electrically interconnects the switch housing 16 with the magnet housing 18. The cable 28 is a self-coiling elastically extensible multi-conductor cable of the sort often used to connect telephone hand sets to the base of a telephone instrument. When relaxed, such a cable assumes a neat, helically-coiled relaxed configuration. However, a cable of this sort including four electrical conductors can be stretched to extend as far as eight times the length of the helical coil and thereafter return to the original relaxed state in which the cable 28 is shown in FIGS. 3 and 4. The electrical conductors of such a cable are individually insulated, while also being protected against sharp bends by the outer cover of the cable. The resiliency of the cable cover thus protects the conductors from concentration of stresses which might otherwise cause early failure of the conductors, resulting in false indication of breakage of the glass pane 14.

When the door 12 is opened as shown in FIG. 2, the cable 28 extends easily through the distance between the switch housing 16 and the magnet housing 18, yet when the door is closed as shown in FIG. 1, the cable 28 resumes its helically-coiled relaxed state, as shown in FIG. 3, and is contained within a cable cavity 30 defined partially by the switch housing 16, partially by the magnet housing 18, and partially by the surface 23 on which the magnet housing 18 is mounted. As a result, whenever the door 12 is closed, the cable 28 is protected from tampering and hidden from sight within the cavity 30.

Referring now to FIGS. 3–6, the switch housing 16 may be manufactured of injection-molded plastic, and includes a front wall portion 32, which is hollow, defining a switch cavity 34. A terminal board 36 fits within the switch cavity 34, and includes four terminal posts 38, providing for use of the connector assembly 10 in conjunction with various sensors which may be located on the door 12. The terminal posts 38 may, for example, be of the type in which soldered connections may be made on one side of the terminal board 36 and screw posts are provided on the side which is normally exposed. The terminal board 36 is normally adhesively secured within the front wall 32.

A magnetically actuated switch 40 is connected electrically to two of the terminal posts 38, being supported by the terminal posts 38 at a desired location within the switch cavity 34 when the terminal board 36 is located in the switch cavity 34. While the reed switch 40 shown herein is a simple, normally open switch, it will be appreciated that other forms of magnetic reed switch may be utilized, and that, in particular, reed switch assemblies embodying the inventions disclosed in U.S. Pat. Nos. 4,210,888 and 4,213,110, the disclosures of which are hereby incorporated herein, may be particularly useful in some instances.

A side wall 42 has an inner surface 44 which is parallel with the surface 22 on which the switch housing 16 is mounted. The front wall 32 of the switch housing 16 has an inner surface 46 which is perpendicular to the inner surface 44. An upper end wall 48 and a lower end wall 50 cooperate with the inner surfaces 44 and 46 of the side and front walls 42 and 32, respectively, to define part of the cable cavity 30 within the switch housing 16.

The magnet housing 18 may also be injection molded of plastic and includes a double side wall 51 having an inner surface 52, and a front wall 54, which is perpendicular to the inner surface 52. The magnet housing 18 also includes a top end wall 56 and a bottom end wall 58, which together with the inner surface 52 and front wall 54 define the remainder of the cable cavity 30, when the switch housi2ng 16 and magnet housing 18 are aligned with one another as shown in FIG. 1.

A pair of brackets 60 are located within the magnet housing 18, defining the location for an actuating magnet 62, which may be adhesively attached to the brackets 60 with a self-curing adhesive resin, in the location shown in FIG. 3, so that when the switch housing 16 and magnet housing 18 are aligned with one another as shown in FIGS. 1 and 3, the actuating magnet will properly actuate the reed switch 40.

So that the elastically extensible connector cable 28 will return to its proper location within the cable cavity 30 when the magnet housing 18 is moved to the proper position with respect to the switch housing 16, one end 64 of the cable 28 is connected to the magnet housing 18 near its top end wall 56, extending through a U-shaped opening 66 provided in the inner side wall 52 of the magnet housing 18. The other end 64 of the elastic cable 28 extends through a hole 67 adjacent the bottom end wall 50 of the switch housing 16. Preferably, a strain-relieving device is provided, such as a clip 68 crimped onto the cable 28 around its outer covering, a short distance from each end 64 of the cable 28, to hold the end of the cable 28 securely and transfer mechanical loads, imposed by stretching the cable, to respective locations in the switch housing 16 and magnet housing 18. Alternatively, a slightly different strain relief device might be anchored securely in holes 37 and 69 in the respective terminal boards 36 or 70. In the magnet housing 18, a terminal board 70 including terminal posts 72 is adhesively secured in place within the side wall 51, closing the U-shaped opening 66 around the respective end 64 of the cable 28. A flange 74 extends from the terminal board 70, parallel with the inner surface 52 of the side wall 51, to a distance even with the rear face of the magnet housing 18.

In both the switch housing 16 and the magnet housing 18, the individual conductors 76 of the cable 28 are connected electrically to the respective terminal posts 38 and 72. This electrically connects the terminal posts 38 with respective counterpart terminal posts 72, so that the connector 10 can be utilized to interconnect the conductors of the cable 20 with conductors such as those of the cable 24. When the cable is so connected, it fits within the cable cavity 30 when in its relaxed configuration, as shown in FIGS. 3 and 4, when it has a relaxed length 77 as shown in FIG. 4.

In mounting the connector and switch housing assembly 10, it is necessary first to connect the individual conductors of the cable 20 to the terminal posts 38 of the terminal board 36, and individual conductors of the cable 24 should be connected to the appropriate ones of the terminal posts 72. The switch housing 16 should be mounted against the surface 22 using fasteners such as the screws 78, with the switch housing 16 located snugly against the door 12 when it is in its properly closed position. Thereafter, the magnet housing 18 is aligned with the switch housing 16 and mounted using fasteners such as the screws 80 to fasten it to the surface 23 of the door 12 so that the front wall 54 of the magnet housing 18 and the front wall 32 of the switch housing 16 are aligned to cooperatively form the cable cavity 30 when the door 12 is closed.

Preferably, thin areas 82 and 84 are provided, respectively, in the switch housing 16 and magnet housing 18. These areas can be removed easily to permit cables such as the cables 20 and 24 to extend into the respective housings from the most convenient side.

Figure 7:
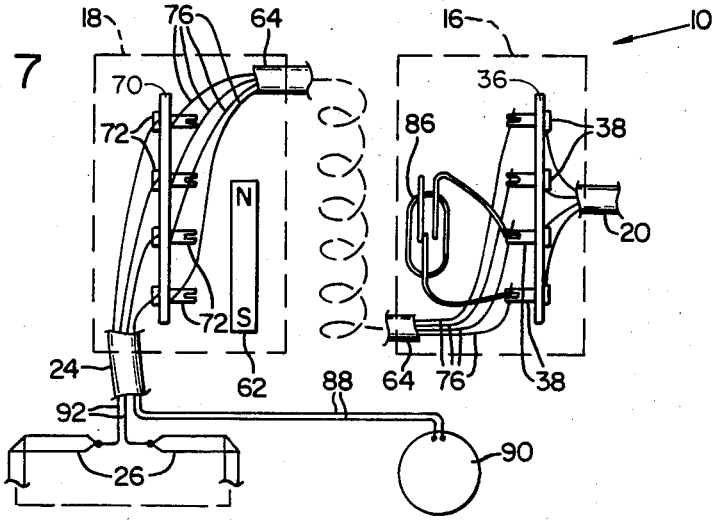
FIG. 7 is an exemplary alarm circuit utilizing the switch housing and connector assembly shown in FIG. 1.

Referring now to FIG. 7, an exemplary utilization of the connector and switch housing assembly 10 is shown partially schematically, with a magnetically actuated switch 86 being of the type which provides an electrically open circuit when the switch 86 is within the field of a sufficiently strong magnet such as the magnet 62. The switch 86 is connected electrically across a pair of the terminal posts 38, and two of the individual conductors 76 which are also connected to the same ones of the terminal posts 38 may be connected, through the terminal posts 72 within the magnet housing 18, to conductors 88 connected to a sensor 90 attached to a pane of glass being protected, the sensor 90 utilizing, for example, a mercury switch to detect excessively high amounts of vibration. The others of the conductors of the cable 20 are connected to the remaining terminal posts 38, and, through others of the individual conductors 76, are connected to other ones of the terminal posts 72 which are in turn connected to the conductor leads 92 to the breakable window foil conductor 26 to form a glass protecting loop which is normally a closed circuit. Thus, the magnetically actuated switch 86 will detect any opening of a door or window with which the connector and switch housing assembly 10 is associated, while the sensor 90 will detect excessive vibration and the glass breakage metal foil conductor 26 will detect breakage of a protected pane such as the window pane 14 of the door 12.

While a preferred embodiment of the connector and switch housing assembly 10 has been described, it will be apparent that in some cases it will be desirable to mount the switch housing 16 on a door and the magnet housing 18 on a door frame, with both being located along a horizontal upper side of the door and doorway and oriented generally horizontally, without departing from the present invention.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A connector assembly for use in electrically connecting a first portion of an electrical circuit carried on a first structure which is reciprocally movable relative to a second structure to a second portion of said electrical circuit mounted on said second structure, said connector comprising:

(a) an elastically extensible cable having a pair of opposite cable ends and including at least one electrical conductor, said cable having a relaxed configuration in which it has a predetermined relaxed length between said cable ends, and said cable being elastically extensible to a substantially increased length;

(b) a first housing adapted for being fixedly mounted on said first structure, one of said opposite cable ends of said cable being attached to said first housing;

(c) a second housing adapted for being fixedly mounted on said second structure, the other of said opposite cable ends of said cable being attached to said second housing; and (d) said first and second housings having matingly corresponding portions defining a cable cavity enclosing said cable with said cable in said relaxed configuration when said housings are mounted respectively on said first and second structures and said first structure is in a first position relative to said second structure, said housings being separated further from each other and said cable being elastically extended to an increased length when said first structure is moved to a second position relative to said second structure.

2. The connector assembly of claim 1, each of said housings including an electrical terminal having at least one terminal post, at least one electrical conductor of said cable being connected electrically to a respective terminal post in each of said housings.

3. The connector assembly of claim 1 wherein each of said housings has a pair of opposite ends which correspond with the opposite ends of the other of said housings, the corresponding ones of said opposite ends of said housings being adjacent one another when said housings are located adjacent one another so as to define said cable cavity, said one cable end of said cable being attached to said first housing within said cable cavity adjacent one of said opposite ends of said housings, and the other cable end of said cable being attached to the second housing within said cable cavity, adjacent the other of said opposite ends of said second housing.

4. The connector assembly of claim 1 wherein one of said housings defines a switch cavity separate from said cable cavity.

5. The connector assembly of claim 1 including locator bracket means included in one of said housings for establishing a magnet location relative to said one of said housings.

6. The connector assembly of claim 1 wherein one of said housings defines a switch cavity separate from said cable cavity and the other of said housings includes bracket means for establishing a magnet location relative thereto, said switch cavity and said bracket means being located in predetermined relationship to one another when said housings are aligned in a predetermined orientation and location with respect to one another.

7. The connector assembly of claim 1, each of said housings including an electrical terminal having at least one terminal post and each of said housings including inner wall means for separating said terminal from said cable cavity.

8. A combined switch assembly and connector for connecting one portion of a security alarm electrical circuit to another portion of such a circuit, comprising:

(a) a first terminal housing, adapted for being mounted on a door and including means for defining a mounting place for a magnet;

(b) a second terminal housing, adapted for being mounted on a doorway frame and including means for defining a switch cavity therein;

(c) an elastically resilient cable having a pair of opposite cable ends and including at least one electrical conductor, said cable having a relaxed configuration in which said cable has a predetermined relaxed length, and said cable being elastically extensible to a substantially increased length, said opposite cable ends of said cable being fixedly connected respectively to said first and second terminal housings;

(d) a magnetically actuated switch fixedly located within said switch cavity;

(e) an actuating magnet fixedly attached to said first terminal housing in said mounting place; and (f) said first and second housings having portions cooperatively defining a cable cavity enclosing said cable, with said cable substantially in said relaxed configuration, when said housings are mounted respectively on said door and said doorway frame.

9. The device of claim 8, further comprising within each of said housings a terminal board including a plurality of terminal posts, at least one conductor of said cable being electrically connected with a respective terminal post in each of said housings.

10. The device of claim 8 wherein each of said housings has a pair of opposite end walls which correspond with the opposite end walls of the other of said housings, the corresponding ones of said opposite end walls, respectively, being adjacent one another when said housings are matingly located adjacent one another so as to define said cable cavity, said one cable end of said cable being attached to said first housing within said cable cavity adjacent one of said opposite end walls, and the other cable end of said cable being attached to said second housing within said cable cavity, adjacent the other of said opposite end walls of said second housing.

11. The device of claim 10 wherein said cable is helically coiled in said relaxed configuration.

12. The device of claim 8 wherein said switch cavity is defined separately from said cable cavity, including a terminal board having a plurality of terminal posts, said magnetically actuated switch being electrically connected to and mechanically supported by at least a pair of said terminal posts and said terminal board fitting into said switch cavity in said second terminal housing and enclosing said switch therein.

13. The device of claim 12, wherein each of said housings has a pair of opposite end walls which correspond with the opposite end walls of the other of said housings, the corresponding ones of said opposite end walls, respectively, being adjacent one another when said housings are located adjacent one another so as to define said cable cavity, said one cable end of said cable being attached to said first housing within said cable cavity adjacent one of said opposite end walls, and the other cable end being attached to said second housing within said cable cavity, adjacent the other of said opposite end walls of said second housing, and wherein said magnet housing includes locator bracket means for attaching a magnet thereto, said switch cavity and said locator bracket means being located in predetermined relationship to one another when said housings are aligned in a predetermined orientation and location with respect to one another.

14. The device of claim 8 wherein said first and second housings are adapted for being mounted on respective surfaces of said door and said doorway frame which are mutually perpendicular, each of said housings including a first wall which extends generally perpendicularly toward said surface of said door and a second wall which extends from said first wall generally parallel with said surface of said door when said door is located in a predetermined position so as to define said cable cavity when said door is in said predetermined position.

15. A combined switch and connector device for use in a security alarm circuit for protecting a door, comprising:

(a) a first housing adapted for being mounted against a flat surface of a door, said first housing including a side wall, a front wall connected with and extending generally perpendicular to said side wall, and a pair of opposite end walls, each connected with and extending generally perpendicular to said side wall and said front wall;

(b) a second housing adapted for being mounted in a doorway against a flat surface which is perpendicular to said door when said door is closed, said second housing including a side wall, a front wall connected with and extending generally perpendicular to said side wall, and a pair of opposite end walls each connected with and extending generally perpendicular to said side wall and said front wall of said second housing, said front walls and end walls of said first and second housings, respectively, being of corresponding size and fitting matingly together and said walls including surfaces defining a cable cavity between said first and second housings and said flat surfaces;

(c) said side wall of said first housing including a terminal cavity therein, said terminal cavity being separated from said cable cavity by an inner wall member of said side wall, said inner wall member defining an aperture extending therethrough;

(d) said front wall of said second housing defining a switch cavity therein, said switch cavity being separated from said cable cavity by an inner wall member thereof;

(e) an elastically extensible cable having a pair of opposite cable ends and including at least one electrical conductor, said cable having a relaxed configuration in which it has a predetermined relaxed length between said cable ends, and said cable being elastically extensible to a substantially increased length;

(f) a first terminal board having a plurality of terminal posts, located in said terminal cavity; and (g) a second terminal board having a plurality of terminal posts, located in said switch cavity.

16. The device of claim 15 including a magnetically actuated switch located within one of said housings and a magnet located within the other of said housings, said switch and said magnet being so located within said housings that when said housings are in predetermined position relative to each other defining said switch cavity, said switch is actuated magnetically by said magnet.

* * * * *

UNITED STATES PATENT AND TRADEMARK OFFICE

CERTIFICATE OF CORRECTION

PATENT NO. : 4,543,458

DATED : September 24, 1985

INVENTOR(S) : Thomas J. Holce et al

It is certified that error appears in the above-identified patent and that said Letters Patent is hereby corrected as shown below:

| | | |
|---|---|---|
| Col. 1, | line 9 | Change "hingemounted" to --hinge-mounted-- |
| Col. 1, | line 31 | Change "wit" to --with-- |
| Col. 4, | line 59 | Change "housi2ng" to --housing-- |

Signed and Sealed this

Thirteenth Day of January, 1987

*Attest:*

DONALD J. QUIGG

*Attesting Officer*

*Commissioner of Patents and Trademarks*